US010309275B2

(12) United States Patent
Murakami et al.

(10) Patent No.: US 10,309,275 B2
(45) Date of Patent: Jun. 4, 2019

(54) CONTROL DEVICE FOR OIL PUMP

(71) Applicant: TOYOTA JIDOSHA KABUSHIKI KAISHA, Toyota-shi (JP)

(72) Inventors: Nobuyuki Murakami, Toyota (JP); Hisashi Ono, Okazaki (JP); Yuki Nishida, Anjo (JP)

(73) Assignee: TOYOTA JIDOSHA KABUSHIKI KAISHA, Toyota-shi (JP)

( * ) Notice: Subject to any disclaimer, the term of this patent is extended or adjusted under 35 U.S.C. 154(b) by 506 days.

(21) Appl. No.: 14/743,273

(22) Filed: Jun. 18, 2015

(65) Prior Publication Data

US 2015/0377098 A1 Dec. 31, 2015

(30) Foreign Application Priority Data

Jun. 27, 2014 (JP) ..... 2014-132774

(51) Int. Cl.

| | |
|---|---|
| ***F01M 1/16*** | (2006.01) |
| ***F01M 1/02*** | (2006.01) |
| ***F04C 2/10*** | (2006.01) |
| ***F04C 14/22*** | (2006.01) |
| *F04B 49/12* | (2006.01) |

(52) U.S. Cl.

CPC ..... *F01M 1/16* (2013.01); *F01M 1/02* (2013.01); *F04C 2/102* (2013.01); *F04C 14/226* (2013.01); *F01M 2001/165* (2013.01); *F02D 2250/11* (2013.01); *F04B 49/12* (2013.01); *F04C 2210/203* (2013.01); *F04C 2240/81* (2013.01); *F04C 2240/811* (2013.01)

(58) Field of Classification Search

CPC ..... F01M 1/16; F01M 2001/165; F02D 19/0655; F02D 19/084; F02D 19/085; F02D 19/087; F02D 19/088; F02D 2250/11; F04B 49/12; F04C 14/18–226

USPC ..... 123/196 R; 73/53.05; 417/274, 220

See application file for complete search history.

(56) References Cited

U.S. PATENT DOCUMENTS 2,432,130 A * 12/1947 Serrell ..... F16N 39/002 184/6.13
2005/0188685 A1* 9/2005 Folliot ..... F02D 41/0275 60/286

(Continued)

FOREIGN PATENT DOCUMENTS

JP 56-165711 A 12/1981
JP 63-179115 A 7/1988

(Continued)

*Primary Examiner* — Mahmoud Gimie
*Assistant Examiner* — Joshua Campbell
(74) *Attorney, Agent, or Firm* — Oblon, McClelland, Maier & Neustadt, L.L.P.

(57) ABSTRACT

A control device for a variable-capacity oil pump provided in an engine using alcohol-containing fuel includes an electronic control unit. The electronic control unit is configured to: (i) estimate an alcohol concentration in oil of the engine, and (ii) correct a capacity of the oil pump to be increased in a correction condition as compared with a case where the correction condition is not established when the correction condition is established. The correction condition is that an estimated alcohol concentration is a predetermined concentration or more and a temperature of the oil is a predetermined temperature or more.

14 Claims, 9 Drawing Sheets

(56) References Cited

U.S. PATENT DOCUMENTS

| | | | | |
|---|---|---|---|---|
| 2005/0232785 | A1* | 10/2005 | Scholl | F01M 1/16 417/220 |
| 2010/0083937 | A1* | 4/2010 | Tsunooka | F02D 41/0025 123/435 |
| 2014/0303875 | A1* | 10/2014 | Tsukagoshi | F02D 41/123 701/104 |

FOREIGN PATENT DOCUMENTS

| | | | | | |
|---|---|---|---|---|---|
| JP | 05-098921 | | | 4/1993 | |
| JP | 2008128014 | A | * | 6/2008 | |
| JP | 2008128014 | A | * | 6/2008 | |
| JP | 2008267196 | A | * | 11/2008 | |
| JP | 2008267196 | A | * | 11/2008 | |
| JP | 2009-144613 | A | | 7/2009 | |
| JP | 2010-151122 | | | 7/2010 | |
| JP | 2010185282 | A | * | 8/2010 | |
| JP | 2010185282 | A | * | 8/2010 | |
| JP | 2012-132356 | | | 7/2012 | |
| JP | 2012132356 | A | * | 7/2012 | |
| JP | 2012132356 | A | * | 7/2012 | |
| JP | 2012-225271 | | | 11/2012 | |
| RU | 2151906 | C1 | * | 6/2000 | |
| RU | 2151906 | C1 | * | 6/2000 | |
| WO | WO-2013065149 | A1 | * | 5/2013 | F02D 41/123 |

* cited by examiner

CONTROL DEVICE FOR OIL PUMP

INCORPORATION BY REFERENCE

The disclosure of Japanese Patent Application No. 2014-132774 filed on Jun. 27, 2014 including the specification, drawings and abstract is incorporated herein by reference in its entirety.

BACKGROUND OF THE INVENTION

1. Field of the Invention

The present invention relates to a control device for a capacity-variable oil pump, and particularly relates to a capacity control on an oil pump provided in an engine using alcohol-containing fuel.

2. Description of Related Art

Conventionally, an engine is generally provided with an oil pump for lubricating a cylinder, a piston, a crank journal, and the like appropriately, and the oil pump is driven by a crankshaft via a chain or a gear. In view of this, in order to reduce a power loss (pump driving loss) of the engine due to the driving of the oil pump, it is suggested that a variable-capacity oil pump is used (see Japanese Patent Application Publication No. 2012-132356 (JP 2012-132356 A)).

In the meantime, so-called alcohol-containing fuel in which gasoline is mixed with alcohol may have been used in an automotive engine in recent years. Properties of such fuel change depending on a concentration of the alcohol, so a correction control to change an operating condition of the engine, such as an air-fuel ratio, is performed according to the concentration, for example. Further, it is also suggested that a control on the oil pump is corrected according to the alcohol concentration in the fuel.

As an example, in an alcohol engine described in Japanese Patent Application Publication No. 5-098921 (JP 5-098921 A), an amount of oil to be supplied to a trochoid inner peripheral surface of a rotary piston engine is corrected to be increased as an alcohol concentration in fuel is higher. That is, a specific heat of alcohol is ⅙ of that of gasoline, and a supply amount of the fuel increases as a concentration of the alcohol is high. As a result, the oil is washed away by the fuel on the trochoid inner peripheral surface, which results in that an oil film is easily discontinued.

However, in the latter conventional example, although the concentration of the alcohol contained in the fuel is considered, inconvenience caused due to mixing and accumulation of the alcohol in the oil is not considered at all. That is, alcohol has a lower volatility than that of gasoline. Therefore, as dilution of the oil by unburned fuel is promoted, the alcohol is accumulated in the oil. In a case where the engine is repeatedly operated without warming up due to short trip, the concentration of the alcohol mixed in the oil may increase rapidly.

An inventor of the present invention found the following fact. That is, when warming up of the engine is finished in a state where the concentration of the alcohol is high as described above and a temperature of the oil exceeds a boiling point of the alcohol in part of an oil supply system, the alcohol vaporizes at a stretch, so that a substantial flow rate of the oil decreases, which causes insufficient supply of the oil to lubrication portions.

SUMMARY OF THE INVENTION

Based on such new findings, the present invention provides a control device for an oil pump which control device restrains that insufficient oil supply to lubrication portions which is caused when alcohol mixed in oil vaporizes at a stretch, as described above, in an engine using alcohol-containing fuel, so as to secure reliability of the engine.

In view of this, according to one aspect of the present invention, a control device for a variable-capacity oil pump provided in an engine using alcohol-containing fuel is provided. The control device for the oil pump includes an electronic control unit. The electronic control unit is configured to: (i) estimate an alcohol concentration in oil of the engine, and (ii) correct a capacity of the oil pump to be increased when a correction condition is established, as compared with a case where the correction condition is not established, that is the correction condition is a condition that an estimated alcohol concentration in oil of the engine is a predetermined concentration or more and a temperature of the oil is a predetermined temperature or more.

According to the above configuration, a concentration of alcohol mixed in the oil is estimated based on operation histories (histories of an oil temperature and a solution temperature of the engine, a fuel injection amount or a load factor, the rotational speed, and the like) of the engine so far and a concentration of alcohol contained in the fuel. Further, it is also possible to estimate (calculate) the alcohol concentration based on an output from an optical sensor or the like disposed in an oil pan. In a case where the alcohol concentration in the oil, thus estimated, is the predetermined concentration or more, when the temperature of the oil reaches the predetermined temperature or more and the alcohol vaporizes at a stretch, supply of the oil to lubrication portions might become insufficient as described above.

In contrast, with the control device for the oil pump according to the present invention, when the alcohol concentration in the oil is the predetermined concentration or more and the temperature of the oil is the predetermined temperature or more, that is, the correction condition is established, a discharge amount per rotation of the oil pump, that is, the capacity of the oil pump is corrected to increase. This increases the discharge amount of the oil, so that even if a substantial flow rate of the oil decreases due to vaporization of alcohol contained in the oil, insufficient supply of the oil to the lubrication portions can be restrained. This accordingly can secure reliability of the engine.

Here, the predetermined temperature in the correction condition may be set in association with a boiling point of the alcohol in the oil. Since a boiling point of the alcohol changes according to pressure, the predetermined temperature may be set in consideration of a pressure in an area (e.g., an intake side of the oil pump) in which the pressure is relatively low in an oil supply system of the engine.

That is, when the rotational speed of the engine is high or a viscosity of the oil is high, for example, a negative pressure on the intake side of the oil pump easily increases (a hydraulic pressure easily decreases). Accordingly, in consideration of a decrease in the boiling point of the alcohol, in the control device for the oil pump, the predetermined temperature of the correction condition may be corrected based on the rotational speed of the engine such that the predetermined temperature is corrected to a lower temperature side as rotational speed of the engine is higher. Further, a viscosity of the oil may be estimated so that the predetermined temperature may be corrected to a lower temperature side as an estimated viscosity of the oil is higher.

Meanwhile, the predetermined concentration of the alcohol in the correction condition affects a degree of insufficient supply of the oil to the lubrication portions when the alcohol vaporizes at a stretch. In view of this, while considering an operation condition of the engine such as a load factor or the rotational speed, how much insufficient oil supply causes what kind of damage in the lubrication portions is examined by experiment/simulation.

Further, in consideration that increase correction of the capacity of the oil pump to restrain insufficient supply of the oil causes an increase in power loss of the engine for driving the pump, the predetermined concentration of the alcohol in the correction condition may be set appropriately so that such an increase in pump driving loss is not caused as much as possible and insufficient supply of the oil to the lubrication portions can be restrained.

In the control device for the oil pump according to the present invention, the predetermined concentration of the alcohol in the correction condition may be corrected based on a load factor of the engine such that the predetermined concentration is corrected to a lower concentration side as the load factor is higher, or the predetermined concentration may be corrected based on the rotational speed of the engine such that the predetermined concentration is corrected to a lower concentration side as the rotational speed is higher. In other words, these corrections may be performed so as to correct the predetermined concentration to a lower concentration side as the lubrication portions are easily damaged due to insufficient supply of the oil.

Further, when the correction condition is satisfied as such, an increase correction amount of the capacity of the oil pump may be changed according to the concentration of the alcohol included in the oil, the viscosity of the oil, the load factor, the rotational speed, or the like of the engine. That is, as described above, as the concentration of the alcohol included in the oil is higher, a degree of insufficient supply to the lubrication portions easily increases, and further, as the viscosity of the oil is higher, the degree of insufficient supply to the lubrication portions also easily increases. Further, as the load factor or the rotational speed of the engine is higher, the lubrication portions are easily damaged due to insufficient supply of the oil.

In consideration of these facts, in the control device for the oil pump, based on at least one of the alcohol concentration mixed in the oil, the viscosity of the oil, the load factor of the engine, and the rotational speed of the engine, the increase correction amount of the capacity of the oil pump may be set to be larger as the alcohol concentration is higher, as the viscosity of the oil is higher, as the load factor of the engine is higher, or the rotational speed of the engine is higher. However, when the rotational speed of the engine is high, the discharge amount of the oil pump increases accordingly. Accordingly, the increase correction amount based on the rotational speed of the engine may be set relatively low.

Note that, that as the alcohol concentration, the viscosity of the oil, the load factor of the engine, the rotational speed of the engine, or the like is higher, the increase correction amount of the capacity of the oil pump is increased does not necessarily indicate that the increase correction amount is increased continuously as the alcohol concentration or the like is higher. When the alcohol concentration or the like is high, the increase correction amount may be set to be larger than a case where the alcohol concentration or the like is low.

In the meantime, in a state where the load factor of the engine is considerably low like coasting, for example, even if insufficient supply of the oil is caused, the lubrication portions may not be damaged. In this case, increase correction of the capacity of the oil pump may be prohibited so as not to increase a pump driving loss. That is, in the control device for the oil pump, in a case where the engine is in a light-load state in which a load factor of the engine is less than a predetermined value, even when the correction condition is established, the correction control of the capacity of the oil pump may not be performed.

According to the present invention, in a variable-capacity oil pump provided in an engine using alcohol-containing fuel, when an alcohol concentration mixed in oil of the engine is a predetermined concentration or more and a temperature of the oil is a predetermined temperature or more (a correction condition is established), a capacity of the oil pump is corrected to be increased. This makes it possible to restrain that insufficient oil supply to lubrication portions which is caused when alcohol mixed in the oil vaporizes at a stretch, and hereby, it is possible to secure reliability of the engine.

BRIEF DESCRIPTION OF THE DRAWINGS

Features, advantages, and technical and industrial significance of exemplary embodiments of the invention will be described below with reference to the accompanying drawings, in which like numerals denote like elements, and wherein.

DETAILED DESCRIPTION OF EMBODIMENTS

The following describes a first embodiment and a second embodiment of the present invention with reference to the drawings. The embodiments deal with a case where the present invention is applied to an oil pump of an engine provided in an automobile, for example. However, the embodiments are not limited to this.

Figure 1:
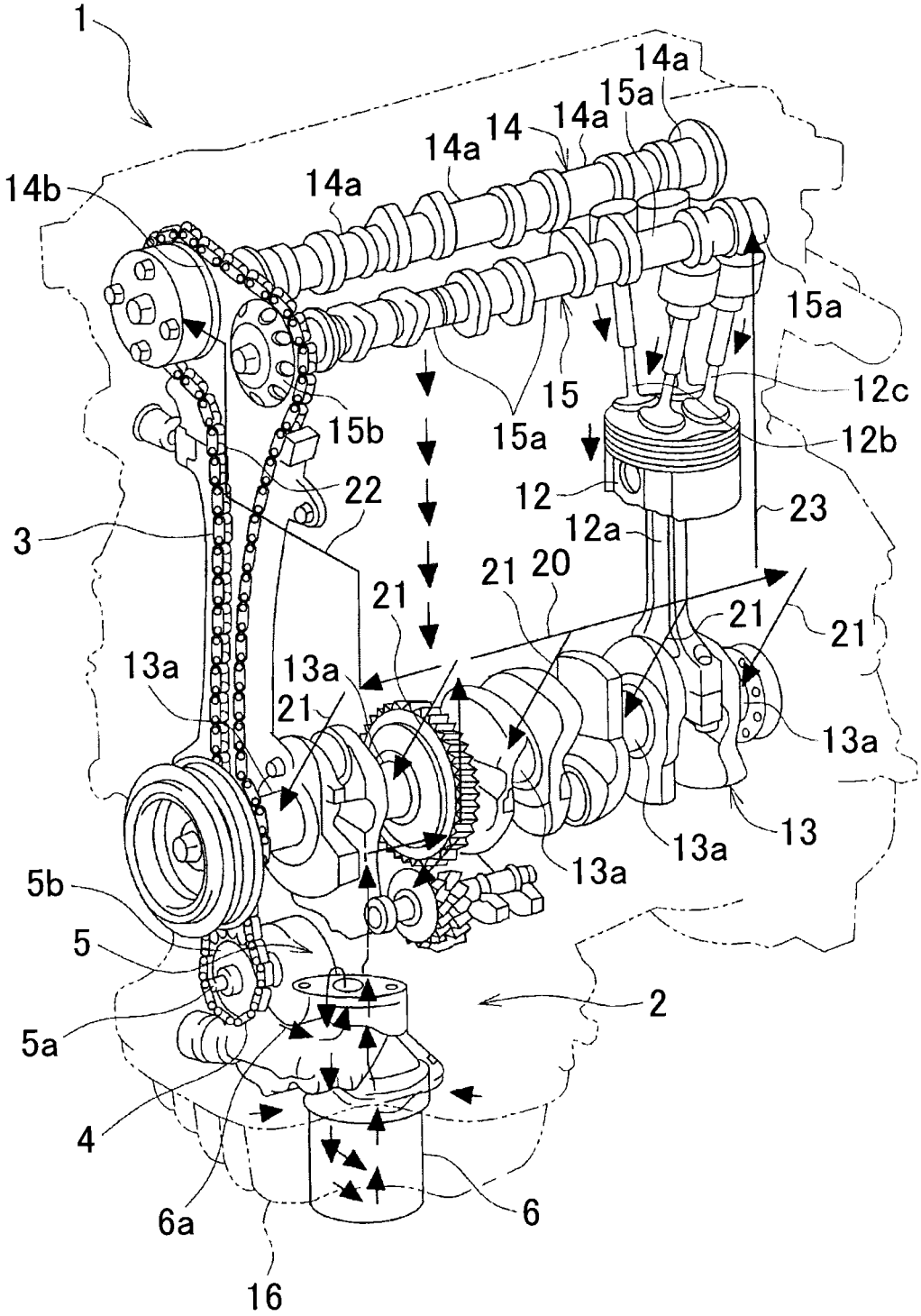
FIG. 1 is a configuration diagram schematically illustrating an oil supply system of an engine, according to an embodiment of the present invention.

First described is a schematic configuration of an oil supply system. As apparent from an outer shape virtually illustrated in FIG. 1, an engine 1 is an in-line multi-cylinder engine provided with a plurality of cylinders (not shown) in a longitudinal direction (a right-left direction in FIG. 1) of a crankshaft 13. Although only one cylinder is illustrated in FIG. 1, a piston 12 is accommodated in each of the cylinders, and the piston 12 is connected to the crankshaft 13 via a connecting rod 12*a*. The crankshaft 13 is rotatably supported in a lower part (a crank case) of the engine 1 by a plurality of crank journals 13*a*.

Further, in an upper part of the engine 1, two intake valves 12*b* and two exhaust valves 12*c* are disposed in each of the cylinder, so as to open and close an intake port and an exhaust port (not shown), respectively. Note that an injector for jetting fuel is disposed in the intake port, so that the fuel is supplied from a fuel tank via a fuel pipe (not shown). Although detailed explanations are omitted, the engine 1 of the present embodiment is configured such that alcohol and gasoline can be used individually or in a mixed manner as fuel, and so-called alcohol-containing fuel is stored in the fuel tank.

As illustrated in FIG. 1, a valve train system of the engine 1 is a DOHC type having two camshafts 14, 15 on an intake side and an exhaust side, and the camshafts 14, 15 are rotatably supported by a plurality of cam journals 14*a*, 15*a*, respectively. Respective cam sprocket 14*b*, 15*b* are attached to front ends (left ends in FIG. 1) of the camshafts 14, 15, so that a rotation of the crankshaft 13 is transmitted thereto via a timing chain 3.

Further, an oil pump 5 is disposed below a front end of the crankshaft 13, and a pump sprocket 5*b* is attached to an input shaft 5*a* of the oil pump 5, so that a rotation of the crankshaft 13 is transmitted thereto via a chain 4. When the oil pump 5 driven by the crankshaft 13 operates, engine oil (hereinafter just referred to as the oil) accumulated in an oil pan 16 in the lower part of the engine 1 is sucked up through an oil strainer (not shown), and then discharged from the oil pump 5 to a discharge oil passage 6*a*.

The oil thus discharged from the oil pump 5 flows through an oil filter 6 from the discharge oil passage 6*a*, and reaches a main gallery 20 of the oil supply system 2. In an example of FIG. 1, the main gallery 20 extends in a longitudinal direction of the engine 1, so as to distribute the oil between lubrication portions of the engine 1 (the piston 12, a cylinder liner, the crank journal 13*a*, the cam journals 14*a*, 15*a*, and so on) via a plurality of branched oil passages.

For example, in FIG. 1, the oil is supplied to the crank journal 13*a* by a plurality of branched oil passages 21 extending downward from the main gallery 20. Further, the oil is supplied to the cam journals 14*a*, 15*a* by branched oil passages 22, 23 extending upward from both ends of the main gallery 20.

Next will be described a structure of the oil pump. The following specifically describes the structure of the oil pump 5 with reference to FIGS. 2 and 3. As illustrated in these figures, the oil pump 5 is an internal gear pump, and includes a drive rotor 51 as an external gear rotated by the input shaft 5*a*, and a driven rotor 52 as an internal gear meshing with this and rotated accordingly. An outer periphery of the driven rotor 52 is held by an adjustment ring 53. As will be described later, the adjustment ring 53 functions as a capacity adjustment member configured to change a capacity of the oil pump (hereinafter also referred to as "pump capacity") by displacing the drive rotor 51 and the driven rotor 52.

Figure 2:
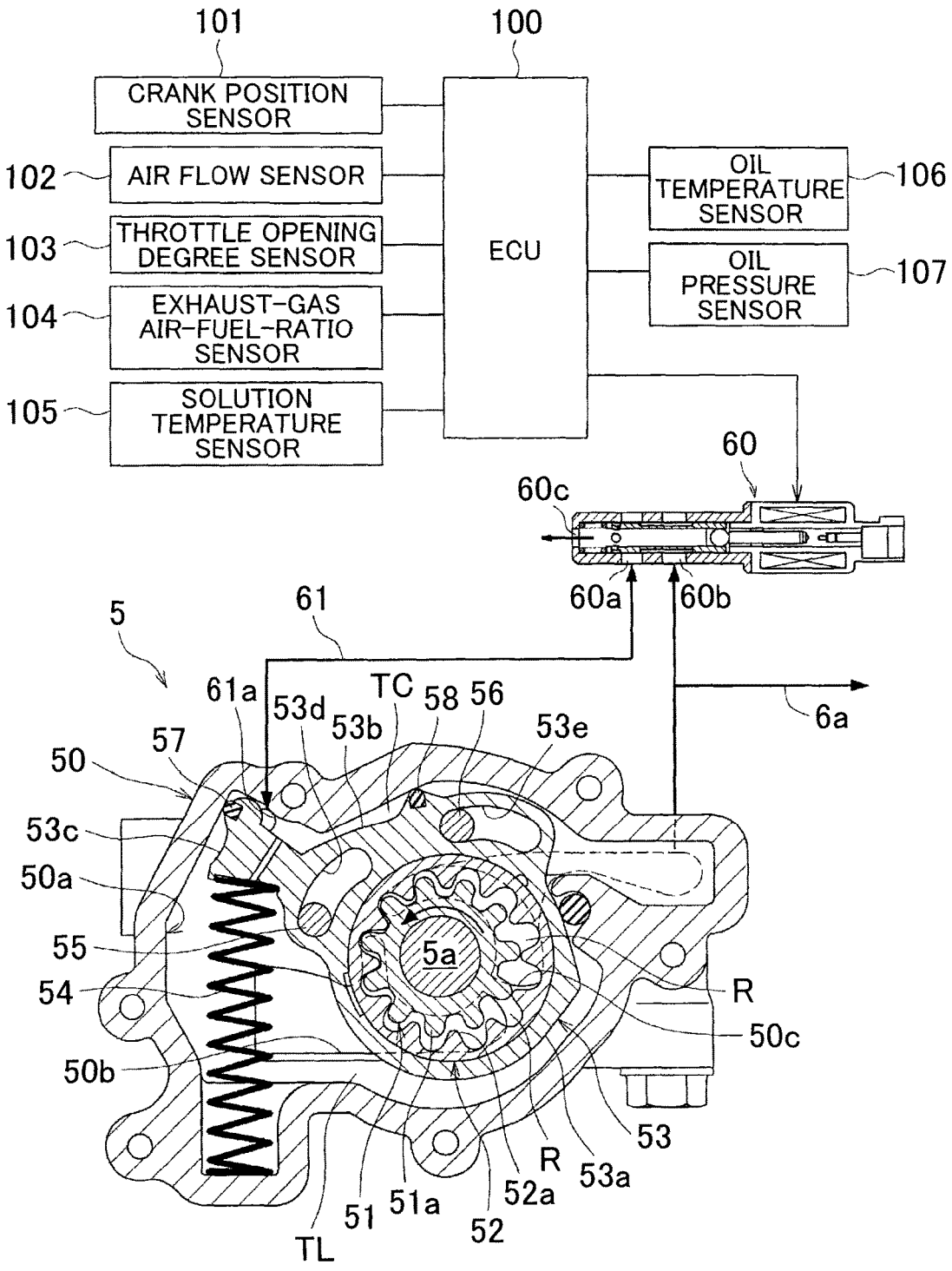
FIG. 2 is a view illustrating a structure of an oil pump (in a state where a capacity of the oil pump is maximum) according to the embodiment, and a schematic configuration of a control system.
Figure 3:
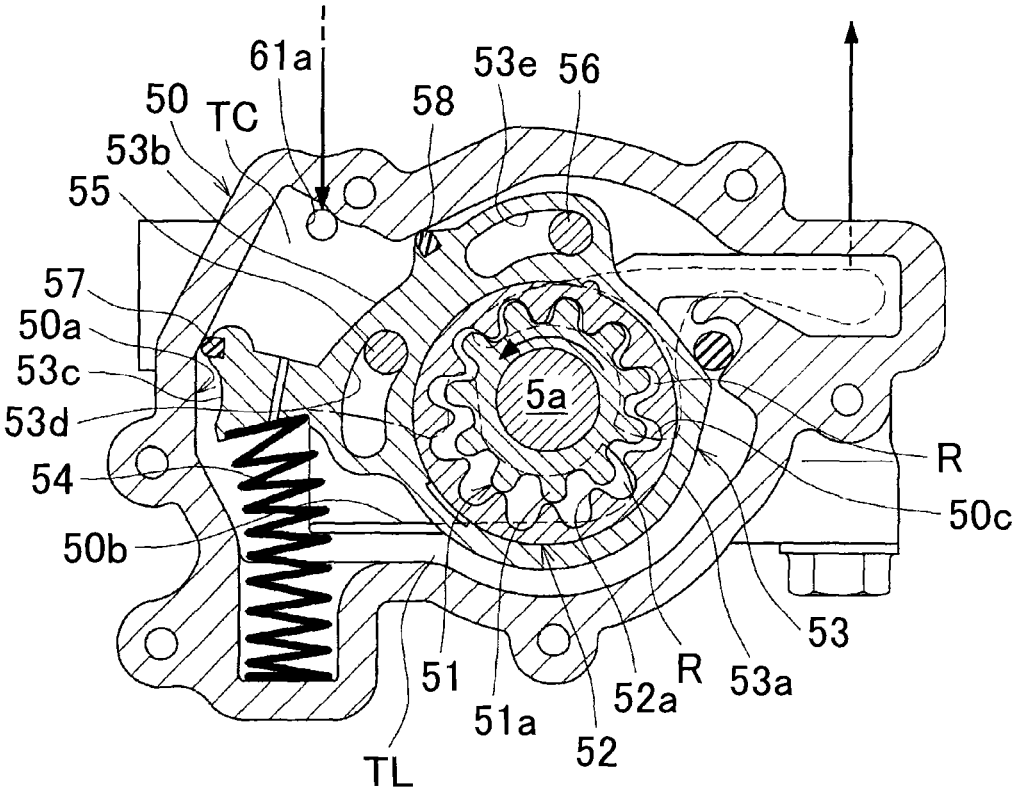
FIG. 3 is a view corresponding to FIG. 2 and illustrates, without the control system, a state where the capacity of the oil pump is minimum.

As illustrated in FIGS. 2, 3, a housing 50 of the oil pump 5 includes a receptacle recessed portion 50*a* formed to be opened toward an inner side of the engine 1, and a cover (not shown) is placed thereon. The receptacle recessed portion 50*a* is configured to receive the drive rotor 51, the driven rotor 52, the adjustment ring 53, and the like. Further, the input shaft 5*a* penetrates around a center of a bottom of the receptacle recessed portion 50*a*, and the aforementioned pump sprocket 5*b* is attached to an end of the input shaft 5*a*.

The drive rotor 51 is attached to the input shaft 5*a* by splines (not shown), for example, and an outer periphery of the drive rotor 51 is provided with a plurality of external teeth 51*a* (11 external teeth 51*a* in the example in the figures) having a trochoid curved line or the like (e.g., involute, cycloid, or the like). In the meantime, the driven rotor 52 is formed in a ring shape, and an inner periphery thereof is provided with a plurality of internal teeth 52*a* meshing with the external teeth 51*a* of the drive rotor 51. The number of internal teeth 52*a* is larger by one (i.e., 12 teeth in the example in the figures) than the number of external teeth 51*a* of the drive rotor 51.

Further, a center of the driven rotor 52 is eccentric relative to a center of the drive rotor 51 by a predetermined amount, and the external teeth 51*a* of the drive rotor 51 mesh with the internal teeth 52*a* of the driven rotor 52 on a side where the center of the driven rotor 52 is eccentric (on an upper left side in FIG. 2). In the meantime, the outer periphery of the driven rotor 52 is slidably held by a ring-shaped body portion 53*a* of the adjustment ring 53. Thus, a trochoid pump having 11 blades and 12 nodes is constituted by the drive rotor 51 and the driven rotor 52 held by the adjustment ring 53, in the present embodiment.

More specifically, as illustrated in FIGS. 2, 3, a plurality of chambers R is formed so as to be aligned in a circumferential direction in an annular space between two rotors 51, 52. Volumes of these chambers R gradually increase or decrease while the chambers R move in the circumferential direction along with rotations of the two rotors 51, 52. A range in which the volumes of the chambers R gradually increase (a range on a lower left side in the figure) is an intake range where the oil is taken in from an inlet port 50*b*. In the meantime, a range in which the volumes of the chambers R gradually decrease (a range on an upper right side in the figure) is a discharge range where the oil is sent out to a discharge port 50*c* with the oil being pressurized.

That is, as indicated by broken lines in FIGS. 2, 3, the inlet port 50*b* is opened for the intake range, and the discharge port 50*c* is opened for the discharge range on a bottom face of the receptacle recessed portion 50*a* of the housing 50. The inlet port 50*b* communicates with an oil passage of the oil strainer via an oil passage (not shown) formed inside the housing 50, and part of the inlet port 50*b* is opened outside the adjustment ring 53 so as to face a low-pressure space TL, which will be described later. Meanwhile, the discharge port 50*c* is formed inside the housing 50 as indicated by broken lines in FIGS. 2, 3, so as to communicate with the discharge oil passage 6*a*.

The oil pump 5 configured as such is driven by the crankshaft 13, so that the drive rotor 51 and the driven rotor 52 rotate while meshing with each other, due to rotation of the input shaft 5*a*. The plurality of chambers R formed between the drive rotor 51 and the driven rotor 52 takes the oil therein from the inlet port 50*b* while moving within the intake range, and then discharges the oil to the discharge port 50*c* while moving within the discharge range.

Next will be described a capacity-variable mechanism. The oil pump 5 of the present embodiment includes a capacity-variable mechanism that can change an amount of oil to be discharged per one rotation of the drive rotor 51 described above, i.e., a pump capacity. The capacity-variable mechanism is configured to pivot (displace) the adjustment ring 53 by a hydraulic pressure of a control space TC formed inside the receptacle recessed portion 50*a* of the housing 50. Due to the displacement of the adjustment ring 53, relative positions of the drive rotor 51 and the driven rotor 52 to the inlet port 50*b* and the discharge port 50*c* are changed, so that the pump capacity is changed.

The adjustment ring 53 includes a ring-shaped body portion 53*a* holding the driven rotor 52, an overhanging portion 53*b* overhanging outwardly from an outer periphery of the body portion 53*a*, and an arm portion 53*c* extending further outwardly relative to the overhanging portion 53*b*. Due to a pressing force of a coiled spring 54 acting on the arm portion 53*c*, the adjustment ring 53 is biased to pivot clockwise in FIG. 2. Further, elongated holes 53*d*, 53*e* are formed in the overhanging portion 53*b* of the adjustment ring 53, so that a pivoting direction of the adjustment ring 53 is regulated by guide pins 55, 56 inserted into the elongated holes 53*d*, 53*e*, respectively.

The arm portion 53*c* of the adjustment ring 53 separates the control space TC and the low-pressure space TL from each other, which are formed side by side in a circumferential direction in the receptacle recessed portion 50*a* of the housing 50. That is, due to a seal material 57 disposed in a tip end of the arm portion 53*c*, flowing of the oil between the control space TC and the low-pressure space TL is limited. The low-pressure space TL is formed from a left side to a lower side in the receptacle recessed portion 50*a* in FIG. 2, and as mentioned earlier, part of the inlet port 50*b* is opened therein, so that the low-pressure space TL communicates with the intake side of the oil pump 5 and its pressure becomes lower than an atmospheric pressure (the pressure becomes a negative pressure).

Meanwhile, the control space TC is formed on an upper left side in the receptacle recessed portion 50*a* in FIG. 2 so that the flowing of the oil is limited by seal materials 57, 58. One end 61*a* of an oil passage 61 (hereinafter referred to as the control oil passage 61) configured to supply a control hydraulic pressure is opened on the bottom face of the receptacle recessed portion 50*a* so as to face its inside. The other end of the control oil passage 61 communicates with a control port 60*a* of an oil control valve (OCV) 60, so that the control hydraulic pressure adjusted by the OCV 60 can be supplied to the control space TC.

That is, the OCV 60 can switch between a state where the oil to be supplied to the supply port 60*b* is sent out to the control oil passage 61 from the control port 60*a* and a state where the oil discharged from the control oil passage 61 is received by the control port 60*a* and discharged from a drain port 60*c*. Further, the OCV 60, which is a linear solenoid valve is configured such that a position of a spool changes in response to an instruction value from an ECU 100, so that the OCV 60 can continuously change a magnitude of the control hydraulic pressure to be sent out from the control port 60*a* as described above.

By adjusting the control hydraulic pressure by such an OCV 60, it is possible to increase or decrease a hydraulic pressure of the control space TC, so as to adjust a pressing force to act on the arm portion 53*c*. That is, due to the hydraulic pressure of the control space TC, a pressing force to pivot the adjustment ring 53 counterclockwise in FIGS. 2, 3 is applied to the arm portion 53*c*. Hereby, a position of the adjustment ring 53 is determined between a state of a maximum pump capacity illustrated in FIG. 2 and a state of a minimum pump capacity illustrated in FIG. 3, so that the pressing force balances with a pressing force of the coiled spring 54.

Next will be described the ECU. A control of the pump capacity by the operation of the capacity-variable mechanism as described above is performed by the ECU 100 for engine control. The ECU 100 of the present embodiment is a well-known ECU including a CPU (Central Processing Unit), a ROM (Read Only Memory), a RAM (Random Access Memory), a backup RAM, and so on. The CPU performs various computing processes based on various control programs and maps stored in the ROM. Further, the RAM temporarily stores therein computing results in the CPU, data input from respective sensors, and the like, and the backup RAM stores therein data and the like to be stored at the time of stop of the engine 1, for example.

As schematically illustrated in FIG. 2, various sensors of the engine 1, such as a crank position sensor 101, an air flow sensor 102, a throttle opening degree sensor 103, an exhaust-gas air-fuel-ratio sensor 104, a solution temperature sensor 105, an oil temperature sensor 106, and a hydraulic pressure sensor 107, are connected to the ECU 100. The ECU 100 executes a predetermined control program for operation control of the engine 1 based on signals or the like to be input from those various sensors.

Further, the ECU 100 learns an alcohol concentration of fuel by executing a predetermined program. That is, the engine 1 of the present embodiment can use alcohol-containing fuel as described above, so the ECU 100 corrects the operation control of the engine 1 according to its alcohol concentration. Note that various methods are well known about the learning, so detailed explanations are omitted herein. However, the ECU 100 can learn and estimate the alcohol concentration based on a change in an actual air-fuel ratio (detected based on a signal from the exhaust-gas air-fuel-ratio sensor 104) caused due to a change in a fuel injection amount according to the alcohol concentration of the fuel, for example.

The ECU 100 operates the capacity-variable mechanism based on an operation condition of the engine 1 as described above, so as to perform a capacity control on the oil pump 5. This basically changes an instruction value to the OCV 60 according to a load factor and the rotational speed of the engine 1, and when the load factor is high, the pump capacity is increased, but when the load factor is low, the pump capacity is decreased. Further, the pump capacity is changed according to the rotational speed of the engine, so that a discharge pressure of the oil is maintained even if the rotational speed of the engine, namely, the rotational speed of the input shaft 5*a* of the oil pump 5 changes.

Figure 4:
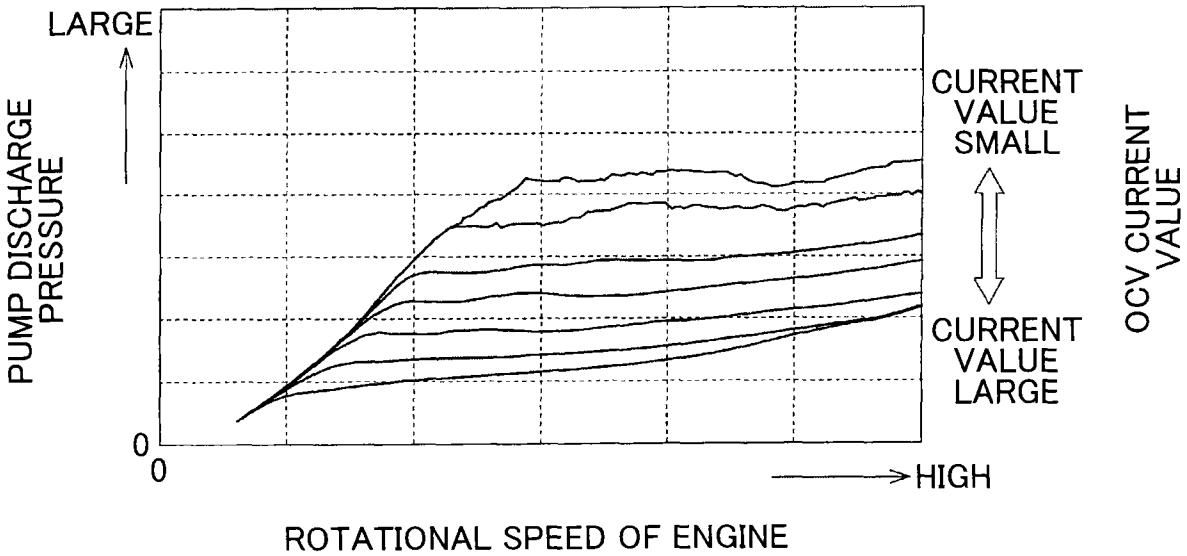
FIG. 4 is a graphical view illustrating a relationship between an OCV current value, the rotational speed of the engine, and a pump discharge pressure in a basic control on the capacity of the oil pump.

As an example, FIG. 4 illustrates a relationship between the instruction value (an OCV current value) from the ECU 100 to the OCV 60, the rotational speed of the engine, and the discharge pressure of the oil pump 5. From FIG. 4, it is found that, if the pump capacity is changed by control of the OCV current value, the pump discharge pressure can be adjusted. That is, if the rotational speed of the engine is higher than a certain degree, the pump discharge pressure can be maintained appropriately without depending on a change in the rotational speed of the engine. This makes it possible to appropriately maintain a hydraulic pressure of the main gallery 20 of the oil supply system 2.

In addition to such a basic control of the pump capacity, the present embodiment focuses the following fact: the oil is diluted by the alcohol-containing fuel during the operation of the engine 1, so that an alcohol concentration of the oil increases, which causes insufficient supply of the oil to the lubrication portions under a predetermined condition. As described below, when a predetermined correction condition is established, a capacity of the oil pump 5 is corrected to be increased.

The following describes a correction control of the capacity of the oil pump 5 in the first embodiment. First of all, in the engine 1 using the alcohol-containing fuel, since alcohol has a lower volatility than that of gasoline, in a case where the engine 1 is repeatedly operated without warming up due to short trip of an automobile, for example, a concentration of alcohol mixed in the oil may increase rapidly.

When a temperature of the oil increases in a state where the concentration of the alcohol is high as such and the temperature of the oil exceeds a boiling point of the alcohol in part of the oil supply system 2 of the engine 1, the alcohol vaporizes at a stretch and bubbles thereof are included in the oil, so that a substantial flow rate of the oil decreases. This may cause insufficient supply of the oil to the lubrication portions such as the piston 12, the cylinder liner, the crank journal 13*a*, the cam journals 14*a*, 15*a*, and so on.

In contrast, in the present embodiment, a concentration of the alcohol mixed in the oil is estimated during the operation of the engine 1 as described above. When the alcohol concentration thus estimated is not less than a predetermined concentration and the temperature of the oil is a predetermined temperature or more and a temperature of the oil is a predetermined temperature or more, it is determined that a correction condition is established. Further, in consideration of a load state of the engine 1, a correction control to increase the capacity of the oil pump 5 is performed.

Figure 5:
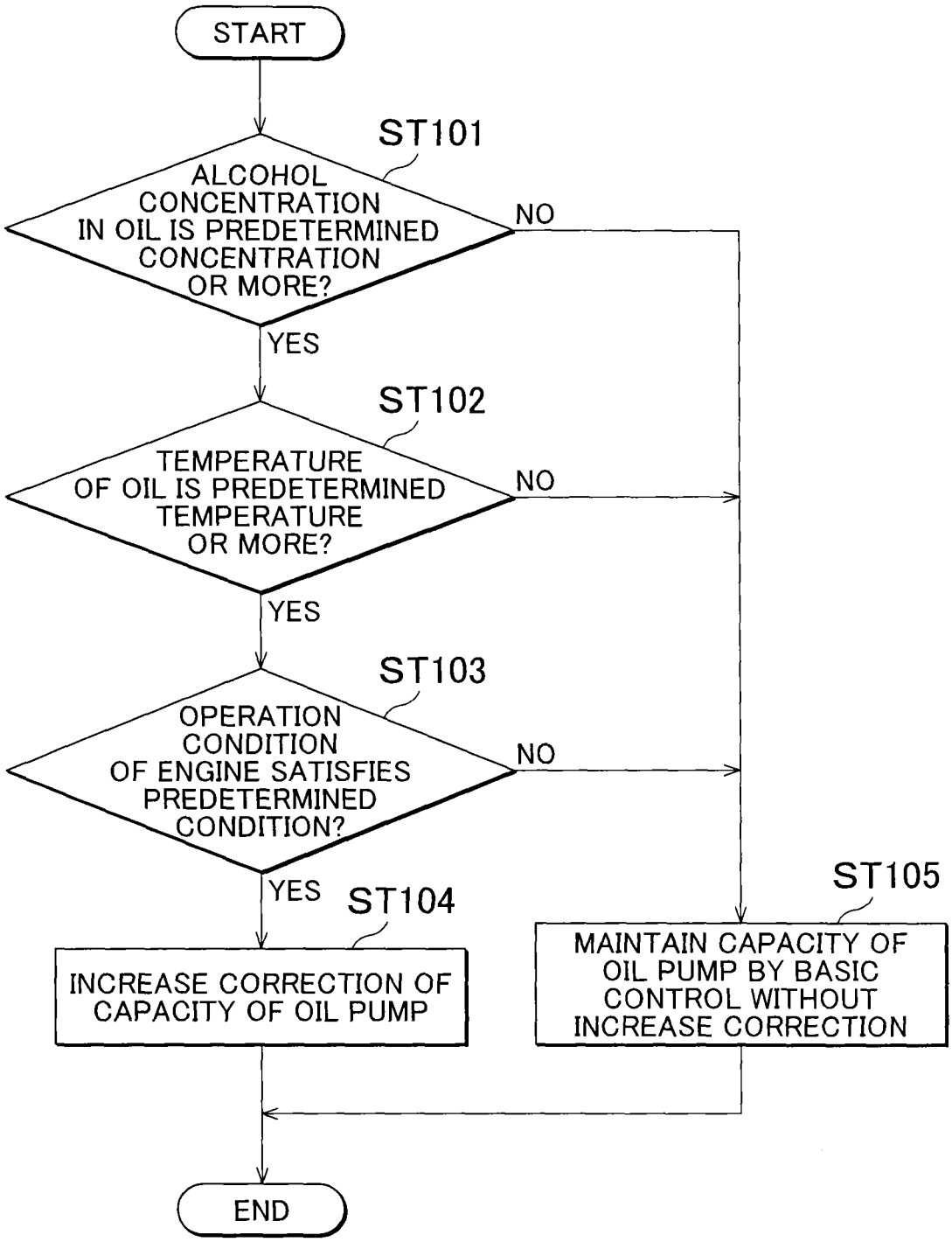
FIG. 5 is a flowchart view illustrating a first embodiment of a correction control on the capacity of the oil pump.

More specifically, FIG. 5 illustrates a flow of a process of the correction control of the pump capacity in the present embodiment. This routine is performed repeatedly in the ECU 100 at a predetermined timing during the operation of the engine 1.

First, in step ST101 after start (START), a concentration of alcohol mixed in the oil is estimated. The mixing of the alcohol to the oil is caused due to dilution of the oil by the alcohol-containing fuel, so the concentration of the alcohol can be calculated based on operation histories (histories of an oil temperature and a solution temperature of the engine 1, a fuel injection amount or a load factor, the rotational speed, and the like) of the engine 1 so far, for example, and an alcohol concentration of the fuel. Note that an optical sensor or the like may be disposed in the oil pan 16, so as to estimate (calculate) the alcohol concentration based on an output from the optical sensor.

For example, a relationship of a temperature of the oil (or an engine solution temperature) and a fuel injection amount (or a load factor) with an amount of change in alcohol concentration per one burning cycle (or one revolution) is found quantatively in advance by experiment/simulation so as to form an alcohol concentration estimation map, which is stored in a memory (ROM) of the ECU 100 electronically. Then, by referring to the alcohol concentration estimation map based on outputs from various sensors during the operation of the engine 1, an alcohol concentration increasing per burning cycle (or engine revolution) is integrated.

That is, if the oil temperature or the solution temperature of the engine 1 is higher than a certain degree, the alcohol mixed due to oil dilution by the fuel vaporizes in a cylinder so as to be burnt, so that the alcohol concentration does not become so high. Further, in this state, even if a very small amount of the alcohol mixed in the oil vaporizes, the oil to be supplied to the lubrication portions does not become insufficient substantially. In contrast, if an operation without warming up is repeated, for example, the alcohol mixed in the oil is accumulated without vaporizing, so that its concentration increases.

After the alcohol concentration increases to a predetermined concentration or more as such, if the alcohol vaporizes at a stretch along with temperature rise of the oil, a lot of bubbles of the alcohol are contained in the oil, so that a substantial flow rate of the oil decreases. This causes insufficient supply of the oil to the lubrication portions. That is, the concentration of the alcohol mixed in the oil indicates a degree of insufficient supply of the oil to the lubrication portions which insufficient supply is caused when the alcohol vaporizes at a stretch.

In view of this, while considering the operation condition of the engine 1 such as a load factor or the rotational speed, how much insufficient oil supply causes how much damage in the lubrication portions is examined by experiment/simulation in advance. Hereby, that degree of insufficient supply which does not cause substantial damage to the lubrication portions is specified, and an alcohol concentration corresponding to this is set as a predetermined concentration of the alcohol to start a correction control. As an example, the predetermined concentration is around 2% to 6%.

In step ST101, the predetermined concentration thus set is compared with the alcohol concentration estimated as described above. If the alcohol concentration is less than the predetermined concentration (negative determination: NO), it is determined that a correction control of the pump capacity is not necessary, and the process proceeds to step ST105 (described later). In the meantime, if the alcohol concentration thus estimated is the predetermined concentration or more (affirmative determination: YES), the process proceeds to step ST102.

In step ST102, a current temperature (an actual oil temperature) of the oil is calculated and compared with a predetermined temperature of the correction condition. The current temperature of the oil may be detected by a signal from the oil temperature sensor 106, but may be estimated based on a signal from the solution temperature sensor 105 and the load factor or the rotational speed of the engine 1. Further, the predetermined temperature is intended to determine whether or not the alcohol mixed in the oil vaporizes at a stretch, so the predetermined temperature may be set corresponding to a boiling point of the alcohol.

However, the boiling point of the alcohol varies depending on pressure, and in a state where the pressure is low, the alcohol easily vaporizes because the boiling point decreases. In view of this, it is preferable that the predetermined temperature be set in consideration of a hydraulic pressure on an intake side of the oil pump 5 on which the pressure is relatively low in the oil supply system 2. For example, first, on the basis of a viscosity of pure oil and the rotational speed of the engine to be used frequently, that boiling point of the alcohol which corresponds to a pressure of the low-pressure space TL in the housing 50 is set as a reference temperature.

Then, the reference temperature is changed in consideration that, as the rotational speed of the engine is higher and as the viscosity of the oil is higher, the pressure of the low-pressure space TL decreases and the boiling point of the alcohol decreases. That is, a relationship of the rotational speed of the engine and the viscosity of the oil with the boiling point of the alcohol is found quantatively in advance by experiment/simulation, so as to form a temperature setting map to set the predetermined temperature based on the relationship, and the temperature setting map is stored in the memory (ROM) of the ECU 100 electronically.

Then, by referring to the temperature setting map based on the rotational speed of the engine and a viscosity of the oil during the operation of the engine 1, the predetermined temperature to start increase correction of the pump capacity is set. Note that various methods are well known about the estimation of the viscosity of the oil, so detailed explanations are omitted herein. However, the viscosity of the oil can be estimated based on an engine solution temperature and a magnitude of a difference between a hydraulic pressure corresponding to an OCV current value (a target hydraulic pressure of the operation condition at that time) and an actual hydraulic pressure, after cold start of the engine 1, for example.

In step ST102, the predetermined temperature thus set is compared with that current temperature of the oil which is detected or estimated as described above. If the temperature of the oil is less than the predetermined temperature (negative determination: NO), it is determined that the correction control of the pump capacity is not necessary, and the process proceeds to step ST105 (described later). In the meantime, if the current temperature of the oil is the predetermined temperature or more (affirmative determination: YES), the process proceeds to step ST103, so as to determine whether or not the operation condition of the engine 1 such as the load factor or the rotational speed satisfies a predetermined condition.

For example, it is determined whether or not the load factor of the engine 1 is a predetermined value or more. If the load factor is the predetermined value or more, affirmative determination (YES) is made, and the process proceeds to step ST104. Here, the correction control of the pump capacity is performed, and the process of the routine is finished (END). An increase correction amount in this case is, for example, to achieve a pump capacity that can supply a necessary amount of the oil to the lubrication portions even if a certain amount of the alcohol vaporizes at a stretch and a substantial flow rate of the oil decreases. The increase correction amount is set in advance by experiment/simulation.

Meanwhile, if negative determination (NO) is made in step ST103 such that the load factor is less than the predetermined value and a light-load state is caused, it is not necessary to perform the correction control of the pump capacity. Accordingly, the process proceeds to step ST105, so as to maintain the pump capacity by the aforementioned basic control, and then the process of the routine is finished (END). That is, in a state where the load factor of the engine 1 is considerably low like coasting, for example, even if insufficient supply of the oil is caused, it is considered that the lubrication portions are not damaged. In this case, increase correction of the pump capacity is prohibited so as not to increase a pump driving loss.

The processing routine of the correction control of the pump capacity as described above is realized by execution of a predetermined program by the ECU 100. In other words, the control device of the oil pump of the present embodiment is mainly constituted by the ECU 100. As described above, when the correction condition about the temperature and the alcohol concentration of the oil is established during the operation of the engine 1, the control device performs the correction control of the pump capacity. Accordingly, even if a substantial flow rate of the oil decreases due to vaporization of the alcohol, insufficient supply to the lubrication portions can be restrained, thereby making it possible to secure reliability of the engine 1.

On the other hand, when the correction condition is not established, the correction control of the pump capacity is not performed, which does not increase a pump driving loss of the engine 1, thereby making it possible to prevent poor fuel efficiency. Further, even if the correction condition is established, the correction control of the pump capacity is not performed in a state where the load factor is considerably low like coasting. Hereby, it is possible to more effectively prevent poor fuel efficiency due to the increase in pump driving loss.

Figure 6:
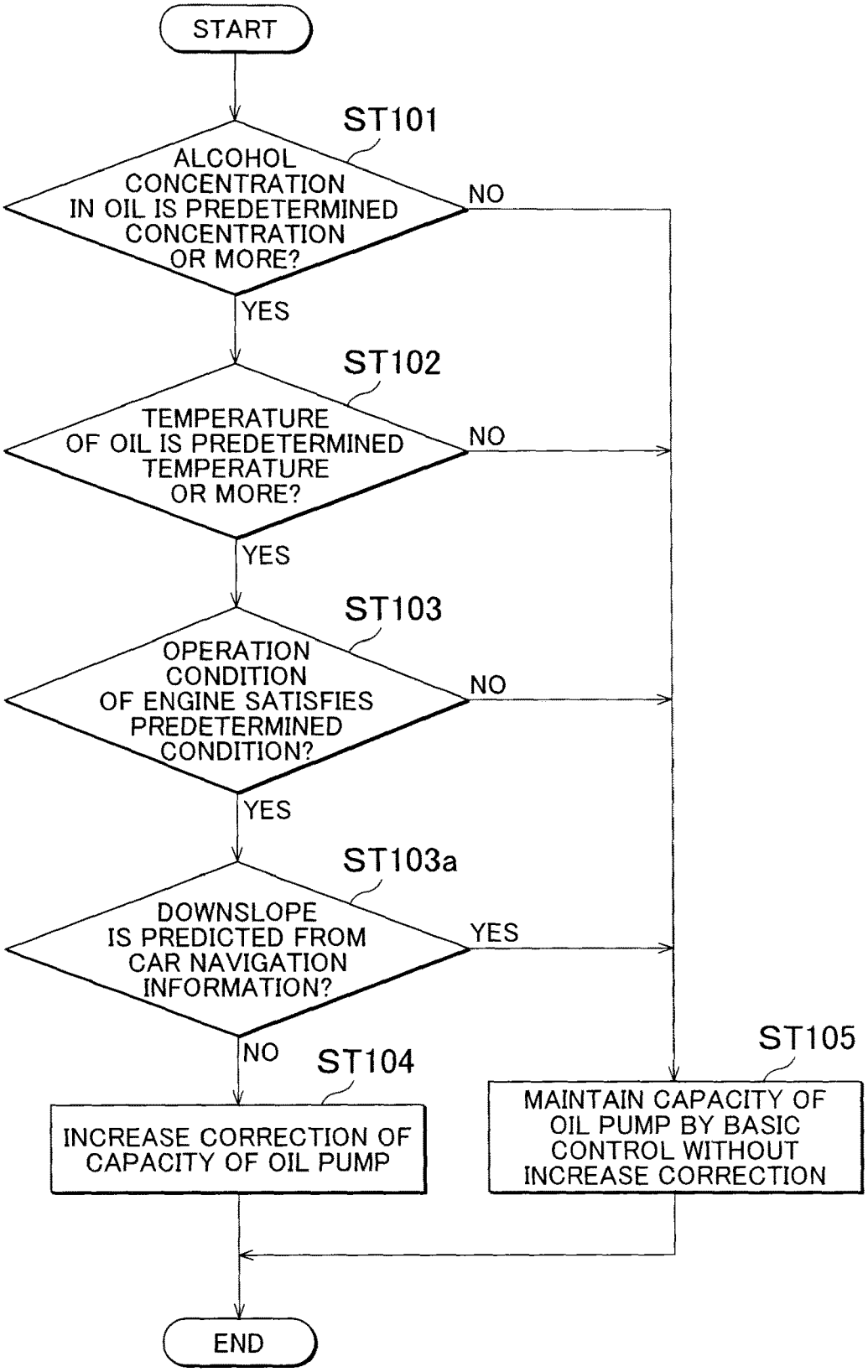
FIG. 6 is a view corresponding to FIG. 5 and illustrates that control device for an oil pump which uses car navigation information, as a modification of a control device for the oil pump of the first embodiment.

Next will be described a modification of the first embodiment. FIG. 6 illustrates a processing routine according to the modification in which information of a car navigation system is used. As an example, in steps ST101 to ST103 after start (START), when it is determined that an alcohol concentration in oil is a predetermined concentration or more (YES), a temperature of the oil is a predetermined temperature or more (YES), and a load factor of the engine 1 is a predetermined value or more (YES), a load to be received by the engine 1 in a course of an automobile is predicted from information of the car navigation system in subsequent step ST103*a*.

That is, it is determined, based on a current vehicle speed, for example, whether or not a downslope of a predetermined degree or more comes within a predetermined time (a downslope is predicted from the information of the car navigation system). If negative determination (NO) is made such that the downslope does not come, the process proceeds to step ST104 so as to perform a correction control of a pump capacity, and then, the process of the routine is finished (END). In the meantime, if affirmative determination (YES) is made in step ST103*a* such that the downslope of the predetermined degree or more comes, the process proceeds to step ST105 so as to maintain the pump capacity by a basic control without performing the correction control, and then the process of the routine is finished (END).

Even in a case where a future operation condition of the engine 1 is predicted by using the car navigation system as such and the correction control of the capacity of the oil pump 5 is necessary from a present status, if it is determined that the correction control becomes unnecessary immediately, the correction control is not performed. Hereby, it is possible to more surely restrain an increase in pump driving loss of the engine 1, thereby making it possible to effectively prevent poor fuel efficiency.

The following describes a correction control of a pump capacity in a second embodiment. In the second embodiment, a correction control of a capacity of an oil pump 5 is performed similarly to the first embodiment described above, but a correction control amount is set according to a concentration of alcohol in oil and a viscosity of the oil, an operation condition of an engine 1, or the like. A configuration of the second embodiment is the same as the first embodiment except this point, so the same member as in the first embodiment has the same reference sign as in the first embodiment, and a description thereof is omitted. Further, a detailed description about the same control procedure as in the first embodiment is also omitted herein.

Figure 7:
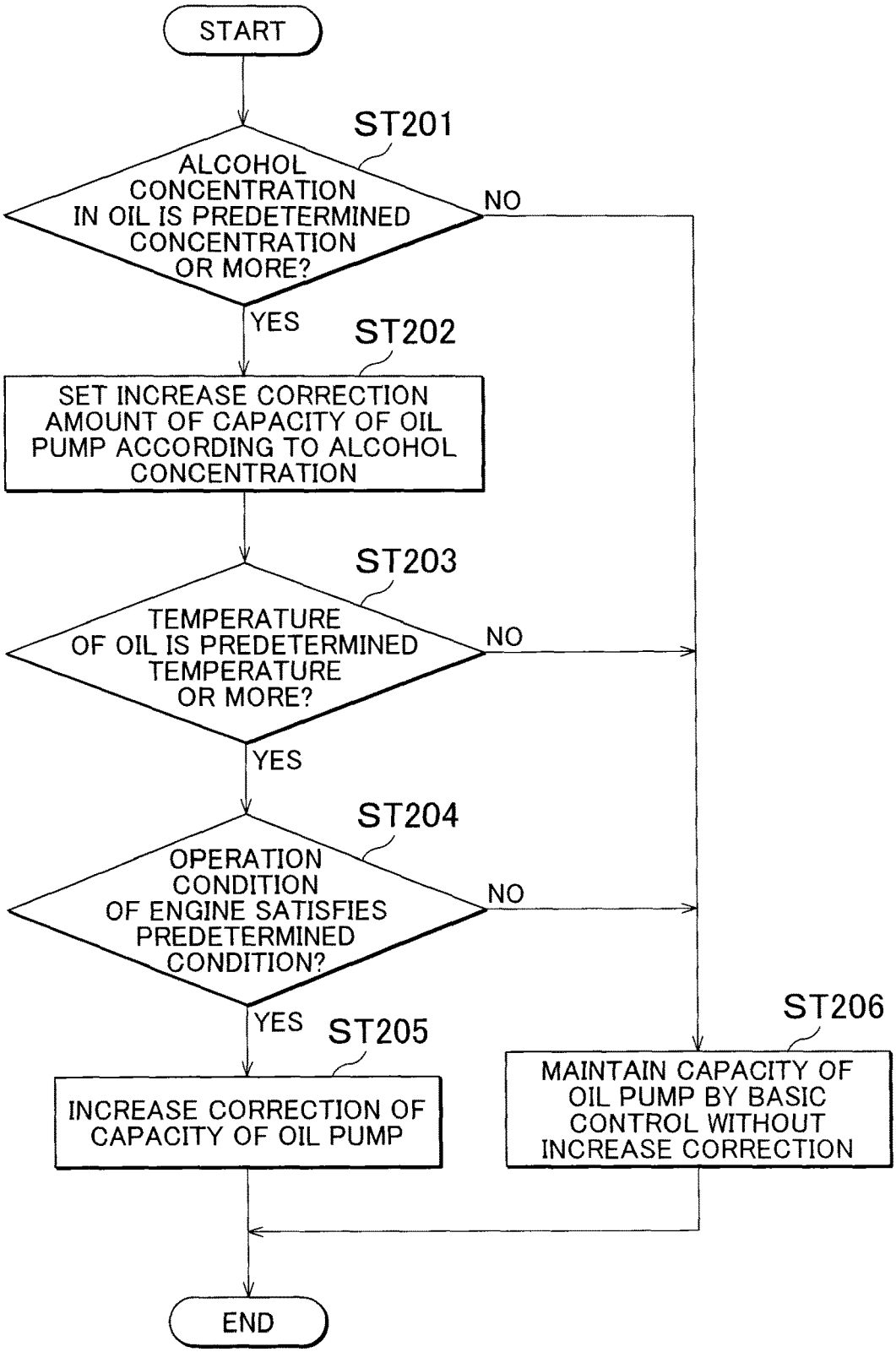
FIG. 7 is a flowchart of a control device for an oil pump of a second embodiment of the present invention in which an increase correction amount of a capacity of the oil pump is set according to an alcohol concentration in oil, and is a view corresponding to FIG. 5 according to the first embodiment.

(Correction Control according to Alcohol Concentration) First of all, FIG. 7 illustrates a flow of a process of setting an increase correction amount of a pump capacity according to a concentration of the alcohol in the oil. First, in step ST201 after start (START), a concentration of the alcohol mixed in the oil is estimated, similarly to step ST101 in the first embodiment described above with reference to FIG. 5. If the alcohol concentration is less than a predetermined concentration (negative determination: NO), the process proceeds to step ST206 described later, and if the alcohol concentration is the predetermined concentration or more (affirmative determination: YES), the process proceeds to step ST202.

In step ST202, an increase correction amount is set so that a pump capacity becomes larger as the alcohol concentration thus estimated is higher. That is, as the alcohol concentration in the oil is higher, a reduction degree of a substantial flow rate of the oil including bubbles of the alcohol becomes larger when the alcohol vaporizes at a stretch. In view of this, that increase correction amount of the pump capacity which allows a necessary amount of the oil to be supplied to lubrication portions even if the substantial flow rate decreases is quantatively found in advance by experiment/simulation, so as to form a correction amount table.

In the table, the increase correction amount of the pump capacity is set so as to correspond to the concentration of the alcohol mixed in the oil, such that the increase correction amount becomes a larger correction amount as the alcohol concentration is higher. Such a correction amount table is electronically stored in a memory (ROM) of an ECU 100. By referring to the table based on the alcohol concentration calculated in step ST201, the increase correction amount of the pump capacity is calculated.

In step ST203 following step ST202, a determination on a temperature of the oil is performed similarly to step ST102 of the first embodiment. If a current temperature of the oil is less than a predetermined temperature (negative determination: NO), the process proceeds to step ST206 described later. Meanwhile, if the current temperature of the oil is the predetermined temperature or more (affirmative determination: YES), the process proceeds to step ST204 so as to perform a determination on an operation condition of the engine 1 similarly to step ST103 in the first embodiment.

Then, even in a case where negative determination (NO) is made such that a load factor of the engine 1 is less than a predetermined value, for example, and a correction condition is established, if it is determined that increase correction of the pump capacity is not necessary, the process proceeds to step ST206 so as to maintain the pump capacity by a basic control, and then the process of the routine is finished (END). In the meantime, if affirmative determination (YES) is made such that the load factor is the predetermined value or more and it is determined that increase correction of the pump capacity is necessary, the process proceeds to step ST205 so as to perform the correction control of the pump capacity, and then, the process of the routine is finished (END).

Accordingly, in the correction control of the pump capacity in the second embodiment, an increase correction amount changes according to the alcohol concentration in the oil, and when the alcohol concentration is high and a degree of insufficient supply of the oil to the lubrication portions is large, the increase correction amount becomes large. In the meantime, when the alcohol concentration is low and the degree of insufficient supply of the oil is small, the increase correction amount becomes small. That is, the increase correction amount of the pump capacity is optimized according to the alcohol concentration in the oil, thereby making it possible to restrain, as much as possible, an increase in pump driving loss due to the increase correction of the pump capacity, while supplying the oil in proper amount so as not to cause insufficient supply to the lubrication portions. Accordingly, it is possible to more effectively prevent poor fuel efficiency of the engine 1.

Figure 8:
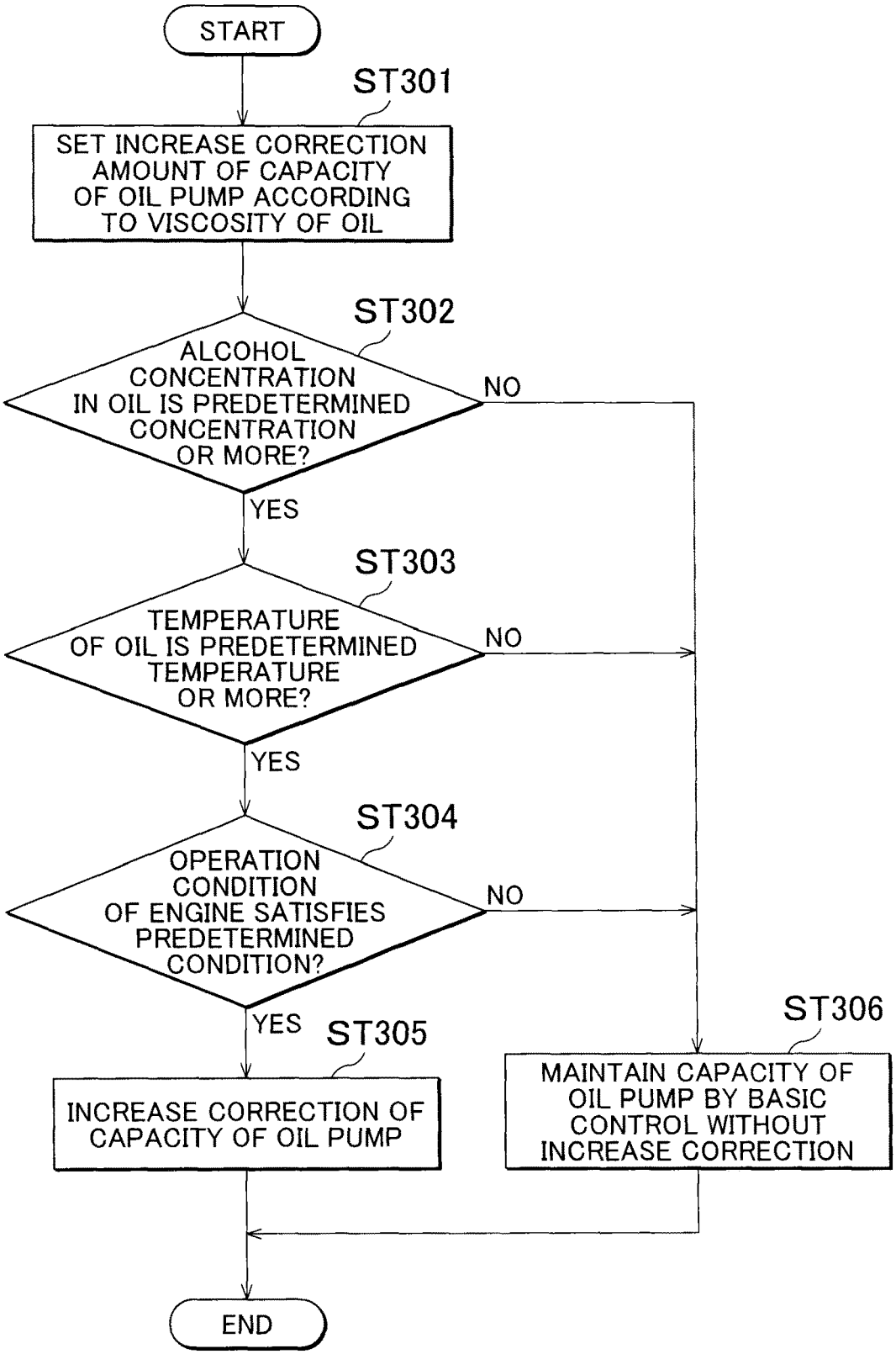
FIG. 8 is a view illustrating a first modification of the second embodiment, is a flowchart illustrating that a correction amount is set according to an oil viscosity, and is also a view corresponding to FIG. 5 according to the first embodiment.

Next will be described a first modification of the second embodiment. In the first modification, a correction control is performed according to a viscosity of oil. FIG. 8 illustrates a flow of a process of setting an increase correction amount of a pump capacity according to the viscosity of the oil. First, in step ST301 after start (START), a viscosity of oil currently used is estimated as described above, and an increase correction amount is set according to the viscosity of the oil. That is, as the viscosity of the oil is higher, a flow resistance of the oil in a flow path increases, so that a degree of insufficient supply to lubrication portions easily increases. Accordingly, as the viscosity of the oil is higher, the pump capacity is increased.

In view of this, a pump capacity that can supply a necessary amount of the oil to the lubrication portions even in a case where alcohol vaporizes at a stretch as described above is set in advance by experiment/simulation in association with the viscosity of the oil. An increase correction amount that achieves such a pump capacity is formed as an increase correction amount table in association with the viscosity of the oil, and the increase correction amount table is electronically stored in a memory (ROM) of an ECU 100. By referring to the table based on that viscosity of the oil which is estimated as described above, an increase correction amount of the pump capacity is calculated.

Subsequently, in step ST302, a concentration of alcohol mixed in the oil is estimated, similarly to step ST101 in the first embodiment. If the alcohol concentration is less than a predetermined concentration (negative determination: NO), the process proceeds to step ST306 described later, but if the alcohol concentration is the predetermined concentration or more (affirmative determination: YES), the process proceeds to step ST303.

In step ST303, a determination on a temperature of the oil is performed similarly to step ST102 of the first embodiment. If a current temperature of the oil is less than a predetermined temperature (negative determination: NO), the process proceeds to step ST306 described later. In the meantime, if the current temperature of the oil is the predetermined temperature or more (affirmative determination: YES), the process proceeds to step ST304 so as to perform a determination on an operation condition of an engine 1 similarly to step ST103 in the first embodiment.

Then, even in a case where negative determination (NO) is made such that a load factor of the engine 1 is less than a predetermined value and a correction condition is established, if it is determined that increase correction of the pump capacity is not necessary, the process proceeds to step ST306 so as to maintain the pump capacity by a basic control, and then the process of the routine is finished (END). In the meantime, if affirmative determination (YES) is made such that the load factor is the predetermined value or more and it is determined that increase correction of the pump capacity is necessary, the process proceeds to step ST305 so as to perform the correction control of the pump capacity, and then, the process of the routine is finished (END).

Accordingly, in the correction control in the this modification, the increase correction amount changes according to the viscosity of the oil, and when the viscosity of the oil is high and a degree of insufficient supply of the oil to the lubrication portions is large, the increase correction amount becomes large. In the meantime, when the viscosity of the oil is low and the degree of insufficient supply of the oil is small, the increase correction amount becomes small. That is, the increase correction amount of the pump capacity is optimized according to the viscosity of the oil, thereby making it possible to restrain, as much as possible, an increase in pump driving loss, while restraining insufficient supply of the oil to the lubrication portions, and to more effectively prevent poor fuel efficiency of the engine 1.

Figure 9:
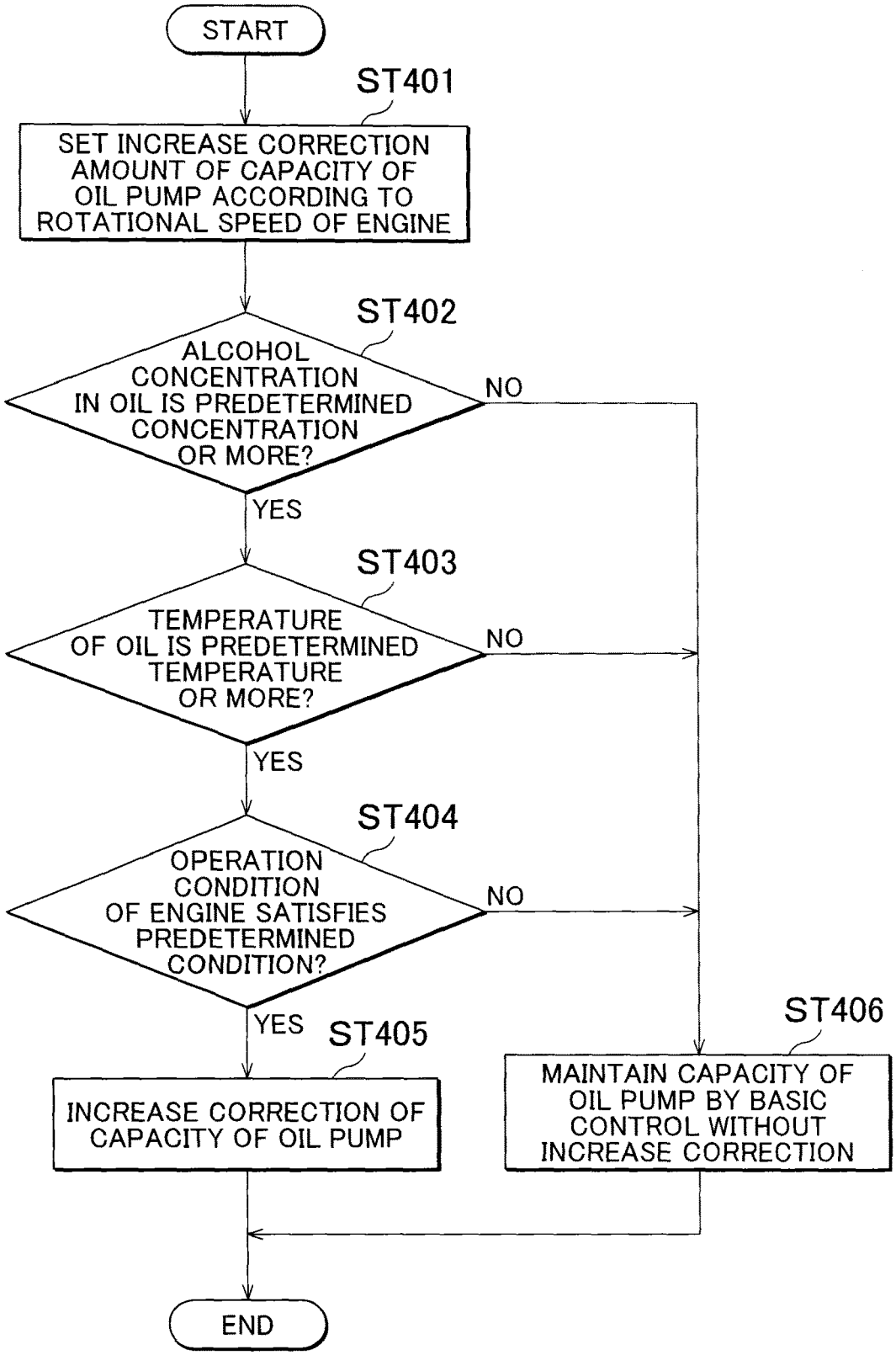
FIG. 9 is a view illustrating a second modification of the second embodiment, is a flowchart illustrating that a correction amount is set according to the rotational speed of the engine, and is also a view corresponding to FIG. 5 according to the first embodiment.

Next will be described a second modification of the second embodiment. In the second modification, a correction control is performed according to the rotational speed of the engine. FIG. 9 illustrates a flow of a process of setting an increase correction amount of a pump capacity according to the rotational speed of the engine. First, in step ST401 after start (START), an increase correction amount of a pump capacity is set according to the rotational speed of the engine. That is, as the rotational speed of the engine is higher, an amount of heat generation in lubrication portions of an engine 1, such as a piston 12 and a crank journal 13*a*, increases. Accordingly, damage easily becomes larger when insufficient supply of oil is caused. As the rotational speed of the engine is higher, the pump capacity is increased so that more oil can be supplied.

More specifically, a pump capacity that can supply a necessary amount of the oil to the lubrication portions even in a case where alcohol vaporizes at a stretch as described above is set in advance by experiment/simulation in association with the rotational speed of the engine. An increase correction amount that achieves such a pump capacity is formed as an increase correction amount table in association with the rotational speed of the engine, and the increase correction amount table is electronically stored in a memory (ROM) of an ECU 100. By referring to the correction amount table based on a current rotational speed of the engine, an increase correction amount of the pump capacity is calculated.

Subsequently, in step ST402, a concentration of alcohol mixed in the oil is estimated, similarly to step ST101 in the first embodiment. If the alcohol concentration is less than a predetermined concentration (negative determination: NO), the process proceeds to step ST406 described later. Meanwhile, if the alcohol concentration is the predetermined concentration or more (affirmative determination: YES), the process proceeds to step ST403.

In step ST403, a determination on a temperature of the oil is performed similarly to step ST102 of the first embodiment. If a current temperature of the oil is less than a predetermined temperature (negative determination: NO), the process proceeds to step ST406 described later. In the meantime, if the current temperature of the oil is the predetermined temperature or more (affirmative determination: YES), the process proceeds to step ST404 so as to perform a determination on an operation condition of the engine 1 similarly to step ST103 in the first embodiment.

Then, even in a case where negative determination (NO) is made such that a load factor of the engine 1 is less than a predetermined value and a correction condition is established, for example, if it is determined that increase correction of the pump capacity is not necessary, the process proceeds to step ST406 so as to maintain the pump capacity by a basic control, and then the process of the routine is finished (END). In the meantime, if affirmative determination (YES) is made such that the load factor is the predetermined value or more and it is determined that increase correction of the pump capacity is necessary, the process proceeds to step ST405 so as to perform the correction control of the pump capacity, and then, the process of the routine is finished (END).

Accordingly, in the correction control in this modification, the increase correction amount changes according to the rotational speed of the engine. When the rotational speed of the engine is high and the lubrication portions easily have larger damage due to insufficient supply of the oil, the increase correction amount increases. In the meantime, when the rotational speed of the engine is low and the lubrication portions are hard to have larger damage, the increase correction amount decreases. That is, the increase correction amount of the pump capacity is optimized according to the rotational speed of the engine. This makes it possible to restrain, as much as possible, an increase in pump driving loss, while restraining insufficient supply of the oil to the lubrication portions, and to more effectively prevent poor fuel efficiency of the engine 1.

Other Embodiments

The descriptions of the first and second embodiments and their modifications are just examples, and are not intended to limit a configuration, a purpose, and the like of the present invention. For example, in the above embodiments, the alcohol concentration in the oil and the temperature of the oil are set as a condition (a correction condition) to perform the correction control on the pump capacity, and the correction control is performed in consideration of the operation condition of the engine 1. However, the operation condition of the engine 1 may not be considered, and if the correction condition is established, the correction control may be performed.

Further, in the above embodiments and the like, a predetermined concentration of the alcohol in the correction condition is set by experiment/simulation so as not to cause substantial damage on the lubrication portions of the engine 1. However, the damage on the lubrication portions changes according to the operation condition of the engine 1 such as the load factor and the rotational speed of the engine. In view of this, based on one of the load factor and the rotational speed of the engine 1, the predetermined concentration may be corrected to a lower concentration side as the load factor is higher or the rotational speed of the engine is higher.

Furthermore, in a case where that temperature of the oil which is detected by the oil temperature sensor 106, for example, rapidly increases by a predetermined degree or more, the predetermined concentration may be corrected to a lower concentration side according to the change of the temperature of the oil. In this case, the predetermined temperature of the oil in the correction condition may be also corrected to a lower temperature side.

Further, in consideration of various influences as such, the predetermined concentration of the alcohol and the predetermined temperature of the oil in the correction condition may be changed in combination, or conversely, the predetermined concentration and the predetermined temperature may not be change at all.

Furthermore, in the second embodiment and the first and second modifications of the second embodiment, the increase correction amount of the pump capacity is changed according to the alcohol concentration in the oil, the viscosity of the oil, and the rotational speed of the engine, respectively. However, these changes may be combined, appropriately. This makes it possible to optimize the increase correction control of the pump capacity by appropriately reflecting all influences of the alcohol concentration in the oil, the viscosity of the oil, and the rotational speed of the engine.

Further, the above embodiments and the like deal with an example in which the present invention is applied to the in-line multi-cylinder engine 1. However, the present invention is not limited to this, and is also applicable to a single cylinder engine, a V-engine, a horizontally opposed engine, and the like. The fuel used in the engine 1 is not limited to gasoline that contains alcohol, but may be fuels obtained by mixing light oil and biodiesel fuel with alcohol, for example.

The present invention relates to a control on an oil pump provided in an engine using alcohol-containing fuel, and is able to restrain poor lubrication that may occur because of vaporization of alcohol mixed in engine oil. Accordingly, the present invention yields a high effect when the present invention is applied to an engine of an automobile, such as FFV.

What is claimed is:

1. A control device for a variable-capacity oil pump provided in an engine using alcohol-containing fuel, the control device comprising:

an electronic control unit configured to:

(i) estimate an alcohol concentration in oil of the engine by comparing an oil temperature of the engine, a fuel injection amount of the engine, and an amount of change in the alcohol concentration in the oil per one burning cycle or one revolution to an alcohol concentration estimation map stored in a memory of the electronic control unit, and (ii) correct a capacity of the oil pump to be increased when a correction condition is established, as compared with a case where the correction condition being a condition that the estimated alcohol concentration in oil is a predetermined concentration or more and a temperature of the oil at a low pressure portion of the oil pump is a predetermined temperature or more.

2. The control device for the oil pump according to claim 1, wherein the electronic control unit is configured to set the predetermined temperature to be in association with a boiling point of alcohol contained in the alcohol-containing fuel.

3. The control device for the oil pump according to claim 2, wherein the electronic control unit is configured to correct the predetermined temperature to a lower temperature side as a rotational speed of the engine is higher.

4. The control device for the oil pump according to claim 2, wherein the electronic control unit is configured to estimate a viscosity of the oil and to correct the predetermined temperature to a lower temperature side as an estimated viscosity of the oil is higher.

5. The control device for the oil pump according to claim 1, wherein the electronic control unit is configured to correct the predetermined concentration based on a load factor of the engine such that the predetermined concentration is corrected to a lower concentration side as the load factor is higher, the load factor being based on the fuel injection amount.

6. The control device for the oil pump according to claim 1, wherein the electronic control unit is configured to correct the predetermined concentration based on a rotational speed of the engine such that the predetermined concentration is corrected to a lower concentration side as the rotational speed is higher.

7. The control device for the oil pump according to claim 1, wherein the electronic control unit is configured to set an increase correction amount of the capacity of the oil pump to be larger as the estimated alcohol concentration is higher.

8. The control device for the oil pump according to claim 1, wherein the electronic control unit is configured to set an increase correction amount of the capacity of the oil pump to be larger as a rotational speed of the engine is higher.

9. The control device for the oil pump according to claim 1, wherein the electronic control unit is configured to estimate a viscosity of the oil and to set an increase correction amount of the capacity of the oil pump to be larger as an estimated viscosity of the oil is higher.

10. The control device for the oil pump according to claim 1, wherein the electronic control unit is configured to set an increase correction amount of the capacity of the oil pump to be larger as a load factor of the engine is higher.

11. The control device for the oil pump according to claim 1, wherein the electronic control unit is configured so as not to perform a correction control on the capacity of the oil pump even when the correction condition is established, when the engine is in a light-load state in which a load factor of the engine is less than a predetermined value.

12. The control device for the oil pump according to claim 1, wherein the oil pump includes a capacity-variable mechanism that changes an amount of oil discharged per revolution of the oil pump, by a pivot ring, of the capacity variable mechanism, that is displaced by a hydraulic pressure in a control portion of the oil pump.

13. The control device for the oil pump according to claim 12, wherein the low pressure portion of the oil pump communicates with an inlet port of the oil pump and has a pressure lower than atmospheric pressure when the oil pump is operating.

14. The control device for the oil pump according to claim 1, wherein the estimate of the alcohol concentration in the oil of the engine also compares at least one of, an oil viscosity, a load factor, and rotational speed on the engine.

* * * * *